United States Patent [19]

D'Augustine et al.

[11] 4,451,243

[45] May 29, 1984

[54] AUTOMATIC MASK-FRAME INSERTER

[75] Inventors: Frank T. D'Augustine, Lancaster, Pa.; Malcolm E. Terry, Marion, Ind.; Hugh F. Welsh, Marion, Ind.; Frank A. Payne, Marion, Ind.

[73] Assignee: RCA Corporation, New York, N.Y.

[21] Appl. No.: 400,062

[22] Filed: Jul. 20, 1982

Related U.S. Application Data

[63] Continuation of Ser. No. 167,475, Jul. 11, 1980, abandoned.

[51] Int. Cl.[3] ..... H01J 9/20

[52] U.S. Cl. ..... 445/68; 445/30

[58] Field of Search ..... 445/30, 68

[56] References Cited

U.S. PATENT DOCUMENTS

| | | | |
|---|---|---|---|
| 3,838,483 | 10/1974 | Baranski et al. | 445/30 |
| 3,899,812 | 8/1975 | Baranski et al. | 445/68 |
| 4,138,774 | 2/1979 | Oyama | 445/68 |

FOREIGN PATENT DOCUMENTS

| | | | |
|---|---|---|---|
| 8467 | 6/1979 | European Pat. Off. | 445/68 |
| 56-26334 | 3/1981 | Japan | 445/68 |
| 693458 | 10/1979 | U.S.S.R. | 445/68 |

*Primary Examiner*—Kenneth J. Ramsey

*Attorney, Agent, or Firm*—Eugene M. Whitacre; Dennis H. Irlbeck; Lester L. Hallacher

[57] ABSTRACT

An automatic apparatus is provided for inserting a mask assembly into a cathode ray tube faceplate panel. The mask assembly includes an apertured shadow mask having at least three springs attached to it with each spring including an aperture. The faceplate panel includes a viewing faceplate portion and a peripheral sidewall. The sidewall includes at least three studs embedded therein for engagement with the spring apertures. The automatic apparatus includes a subassembly at each mask spring location. At least three of said subassemblies are movable horizontally and include a stop for contacting the lower edge of a mask spring. Each movable subassembly also includes a locator pin movable between an engaged position and a disengaged position. The locator pin, when in an engaged position, is spaced from the stop a predetermined spacing equal to a standard spacing between a lower edge of a spring and the centerline of the spring aperture plus a predetermined lifting distance. Each movable subassembly further includes a fork-shaped stud finder centered with the location pins.

1 Claim, 16 Drawing Figures

AUTOMATIC MASK-FRAME INSERTER

This is a continuation, of application Ser. No. 167,475, filed July 11, 1980, now abandoned.

BACKGROUND OF THE INVENTION

This invention relates to an apparatus for automatically inserting mask-frame assemblies into faceplate panels of cathode ray tubes.

The desirability of automatically inserting a cathode ray tube shadow mask-frame assembly into a previously matched faceplate panel has been long appreciated within the cathode ray tube industry. Until the present invention, several factors have prevented prior art attempts to develop automatic insertion apparatuses from being successful. The primary factor is that each faceplate panel-mask-frame assembly varies to an appreciable extent from other such assemblies. The main reason for this variation, is that close tolerances cannot be held in manufacturing the glass faceplate panel. Because of this, each mask-frame assembly is unique. Prior art apparatuses have been unable to adapt to such uniqueness. The present invention, however, provides an apparatus which can adjust to account for the variations in mask-frame assemblies and faceplate panels.

SUMMARY OF THE INVENTION

An automatic apparatus is provided for inserting a mask assembly into a cathode ray tube faceplate panel. The mask assembly includes an apertured shadow mask having at least three springs attached to it with each spring including an aperture. The faceplate panel includes a viewing faceplate portion and a peripheral sidewall. The sidewall includes at least three studs embedded therein for engagement with the spring apertures. The automatic apparatus includes a subassembly at each mask spring location. At least three subassemblies are movable peripherally with respect to a mask mounted on the apparatus and include a stop for contacting the lower edge of a mask spring. Each movable subassembly also includes a locator pin movable between an engaged position and a disengaged position. The locator pin, when in an engaged position, is spaced from the stop a predetermined spacing equal to a standard spacing between a lower edge of a spring and the centerline of the spring aperture plus a predetermined lifting distance. Each movable subassembly further includes a fork-shaped stud finder centered with the location pins.

DETAILED DESCRIPTION

Figure 1:
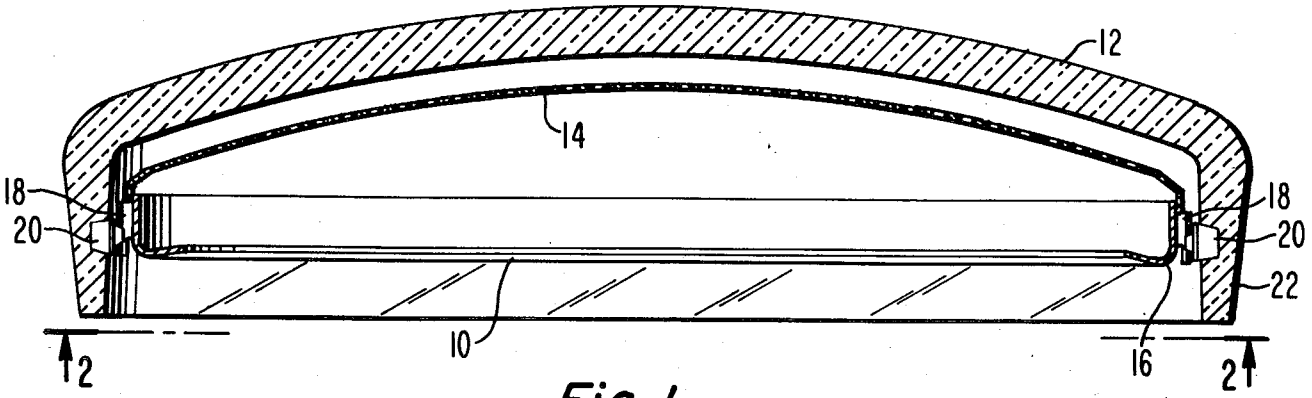
FIG. 1 is a sectional side view of a cathode ray tube faceplate panel with a shadow mask-frame assembly mounted therein.
Figure 2:
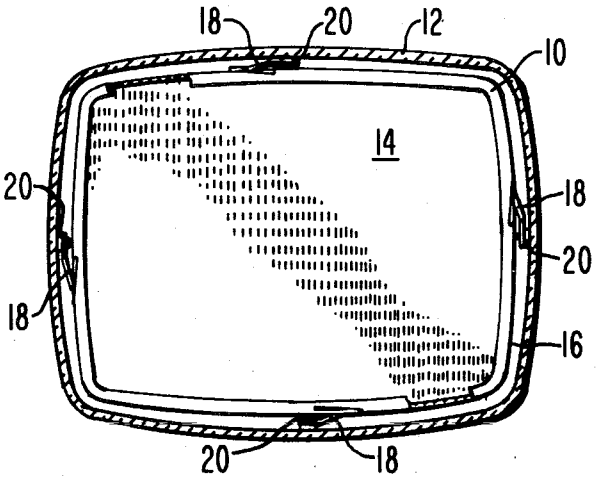
FIG. 2 is a back view of the faceplate panel taken at line 2—2 of FIG. 1.

FIGS. 1 and 2 show a mask-frame assembly 10 mounted within a cathode ray tube faceplate panel 12. The mask-frame assembly 10 includes a domed thin metal apertured shadow mask 14 attached peripherally to an L-shaped reinforcing frame 16. Four springs 18 are attached to the frame 16. Apertures in these springs 18 engage four metal studs 20 which are embedded in a sidewall 22 of the faceplate panel 12.

An apparatus embodying the present invention is used to insert a mask assembly or a mask-frame assembly into the faceplate panel 12. The apparatus includes a subassembly at each mask-frame spring location. Three of these subassemblies are movable peripherally with respect to a mask mounted on the apparatus and include: (1) a stop for contacting the lower edge of spring, (2) a locator pin movable between an engaged position and a disengaged position and (3) a fork-shaped stud finder centered with the locator pin. The fourth subassembly does not require compensating features since its only purpose is to participate in the compression of the spring at its location when the mask-frame assembly is being inserted into the faceplate panel. Since all four springs are previously welded to the frame during a procedure called "Q"-set, if three of the springs are located and fixed by the apparatus, the location of the fourth will also be fixed.

Figure 5:
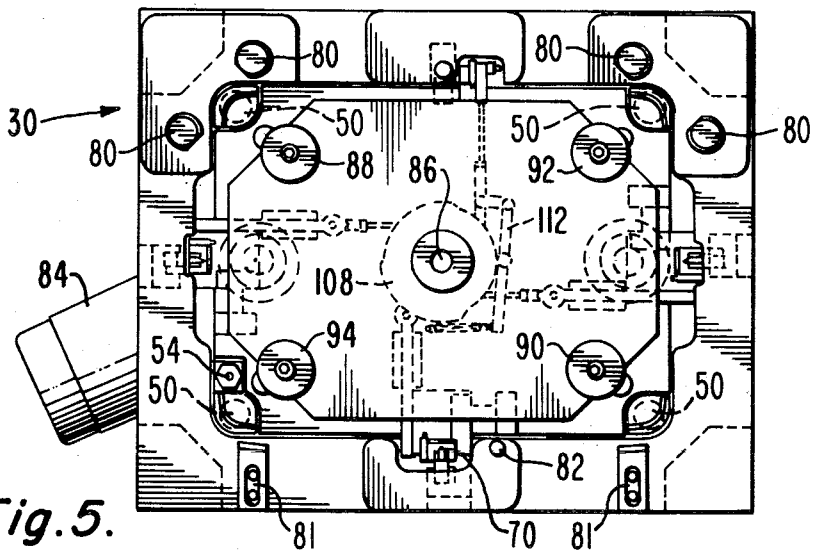
FIGS. 3, 4 and 5 are side, front and top views, respectively, of an automatic mask inserter.
Figure 4:
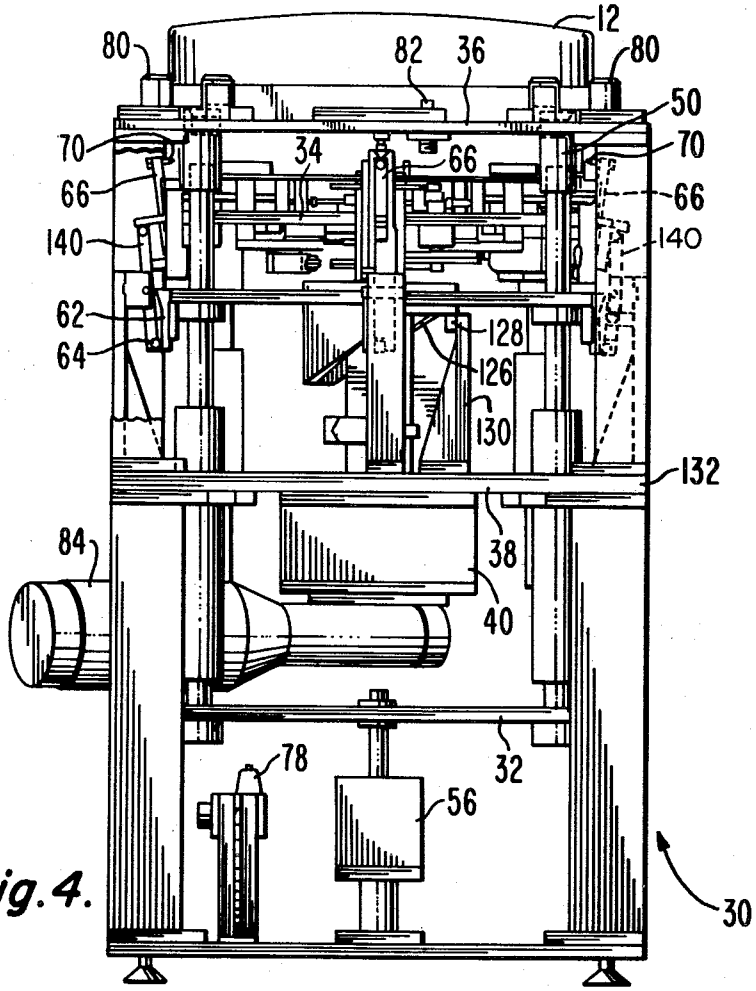
Figure 3:
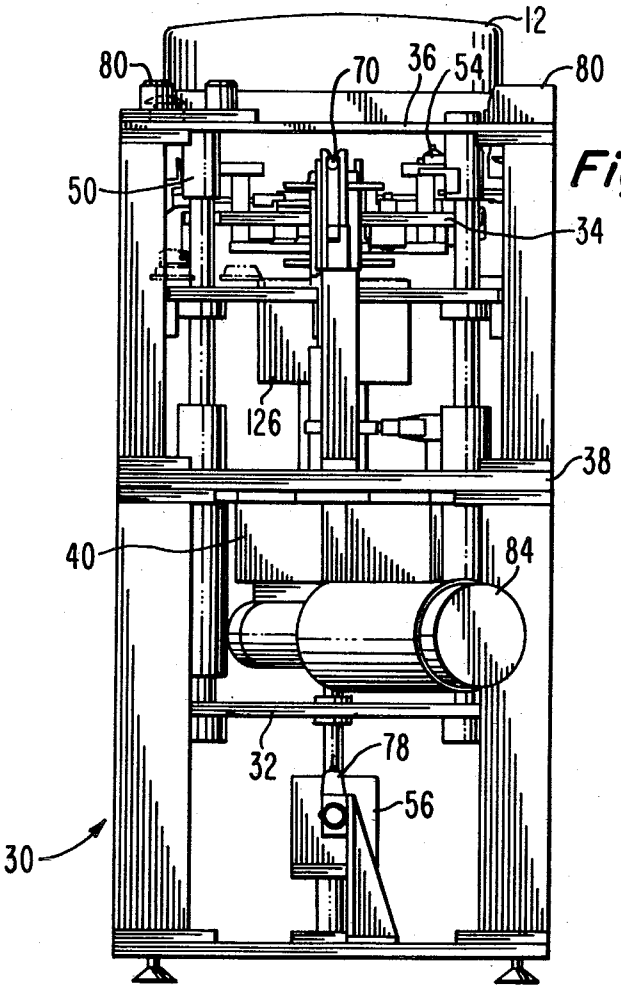

The mask inserter 30 shown in FIGS. 3, 4 and 5 comprises five mechanical subunits. A mask post assembly 32, a mask locator assembly 34, a panel locator assembly 36, a bearing plate assembly 38 and a drive assembly 40. The major components of each of these subunits and the relation of the subunits to each other now will be presented along with the description of the operation of the mask inserter 30.

Figure 7:
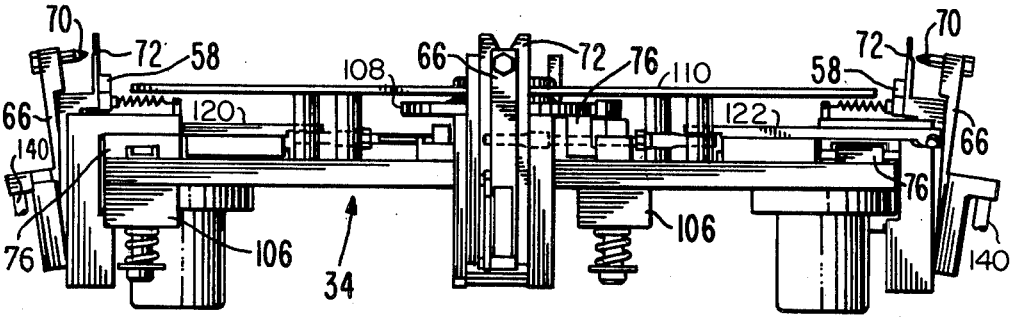
Figure 9:
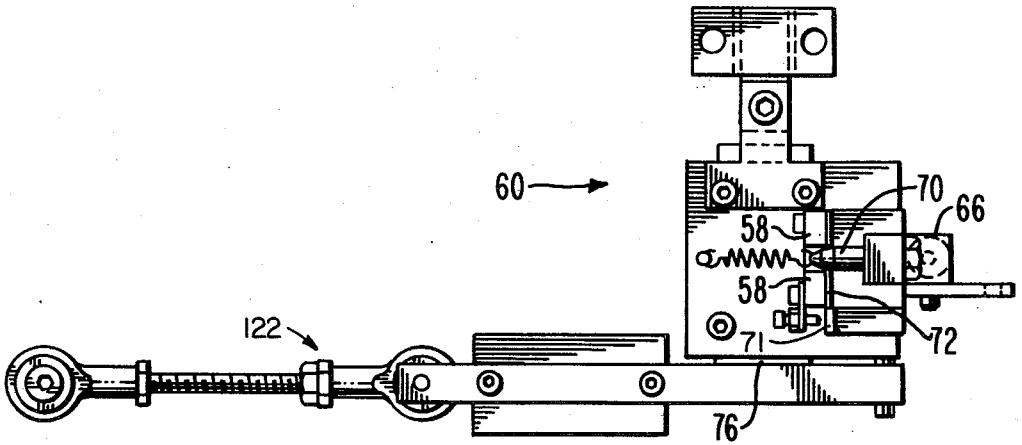
FIGS. 9 and 10 are top and front views, respectively, of a movable pin locating assembly portion of the mask locator assembly of FIGS. 6 and 7.
Figure 10:
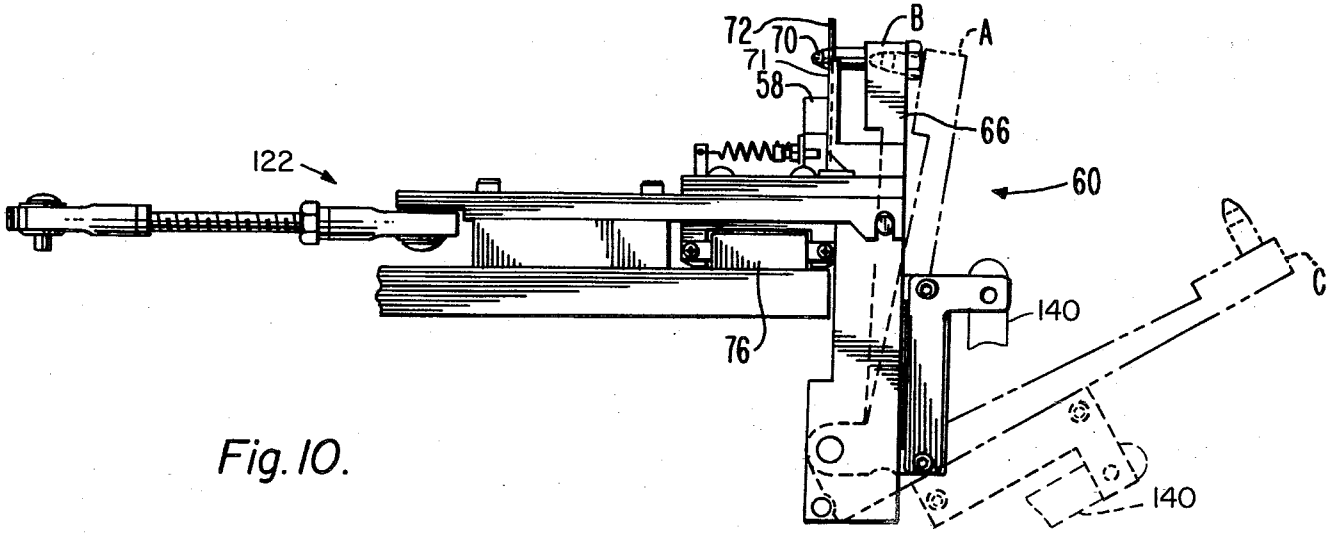

Operation of the mask inserter 30 begins by loading a mask-frame assembly onto four locating nests 50 positioned at the top of the mask inserter 30. These nests 50 roughly locate the mask-frame assembly in relation to three spring hole locating pins described later. The weight of the mask-frame assembly activates a sensor 54 located near one of the locating nests. The sensor causes an air cylinder 56 to lower the mask post assembly unit 32. As shown in FIGS. 7, 9 and 10, as the mask post assembly unit 32 is lowered, a mask-frame assembly, resting on the locating nest 50, is also lowered until the four support springs welded to the frame come into contact with four stops 58 located on three movable pin locating assemblies 60 of the mask locator assembly 34. This is the first in a series of steps to establish reference points and to maintain them in their correct location. The location of the stud hole in the spring is reasonably accurately located in relation to the edge of the spring. By causing the spring edge to rest on a known surface, e.g. the stop 58, the center line of the spring hole is closely established.

After the springs have contacted the stops 58, bringing the mask frame assembly to rest, the mask post assembly 32 continues its downward motion causing a cam 62, mounted thereon and shown in FIGS. 4 and 10, to come into contact with a cam follower 64 on the lower end of a locating pin actuating link 140. During this further downward travel of the mask post assembly unit, the second step in the locating series is taken.

At the moment the mask support springs come into contact with the fixed stops 58, a pivot link 66 is in position indicated by 'A' in FIG. 10. As the mask post assembly 32 moves downward bringing the cam surface 62 into contact with the cam follower 64, a locating pin 70, held in the upper end of the pivot link 66, enters into the spring aperture, as shown in position 'B' of FIG. 10. Because the dimension from the edge of the spring to the center of the hole is held to a reasonably close tolerance, by holding some corresponding greater distance between the surface of the stop and the center line of the locating pin 70, the pin 70 and spring hole are in known relationship to each other. Thus the mask-frame assembly will be elevated a predetermined distance in the vertical plane after the pin 70 has been inserted into the spring aperture. However, due to the difficulties in holding the metal and glass subassemblies to a close tolerance there is still no assurance that the pin and spring hole are aligned in the horizontal plane.

In order to assure correct placement of the mask-frame assembly within the panel, it is essential that the spring hole be held in such a manner as to be centered with the panel stud when the two are brought together. As shown in FIGS. 9 and 10, the locating pin 70 is accurately located in relation to a fork shaped member 72. These two components share the same centerline by being designed and built as intregal parts of the same subassembly. While the pin pivot link 66 is moving the locating pin 70 into position and elevating the mask-frame assembly approximately one thirty-second inch into position, the pin 70 is seeking the centerline of the spring hole in the horizontal plane. This is accomplished by mounting the entire pin locating assembly 60 on movable slides 76 which are free to move in a horizontal plane (peripherally with respect to a mask assembly mounted on the apparatus) while the contoured tip of the pin 70 seeks and enters the spring hole. The engaged position of the pin pivot link 66 with the pin 70 in a spring hole is shown as position 'B' in FIG. 10. At this point, the mask-frame assembly has been captured and the spring holes are accurately located vertically despite all variations within the mask frame assembly. Since the mask-frame-panel assembly previously was welded as a unit, the mask-frame is precisely aligned vertically for final insertion into the faceplate panel.

Figure 8:
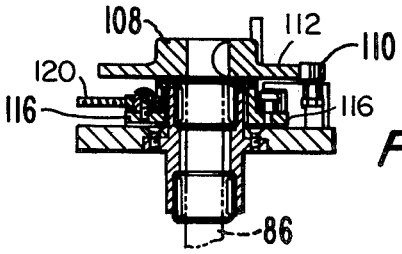
FIG. 8 is a partial sectional view of the mask locator assembly taken at lines 8—8 of FIG. 6.

While the pin-hole search action has been taking place, the mask post assembly 32 has continued its downward movement until it contacts a switch 78 at the bottom of the stroke of the air cylinder 56 as shown in FIGS. 3 and 4. Activation of the switch 78 enables the inserter control systems to proceed to the next operation. A faceplate panel is loaded onto guides 80 and 81 at the top of the inserter 30, as shown in FIGS. 3, 4 and 5. These guides 80 and 81 roughly locate the faceplate panel in relation to the support springs previously located within the apparatus. When the faceplate panel is placed on the guides 80 and 81 it contacts a sensor 82, shown in FIG. 5. Signal from the sensor 82 prepares the unit to be triggered to complete its cycle which is done by the operator depressing two start switches, not shown. When the operator despresses the switches, an electric motor 84 starts which turns a main cam shaft 86, shown in FIGS. 8 and 11. This shaft rotates a series of cams 96, 108, 116, and 126 which are so keyed together as to preserve timing integrity.

As previously explained, the mask frame assembly has been positively located into a vertically true position. It is now necessary to take action to preserve this condition while preparing the apparatus to accomplish the actual insertion of the mask-frame assembly into the faceplate panel.

Figure 12:
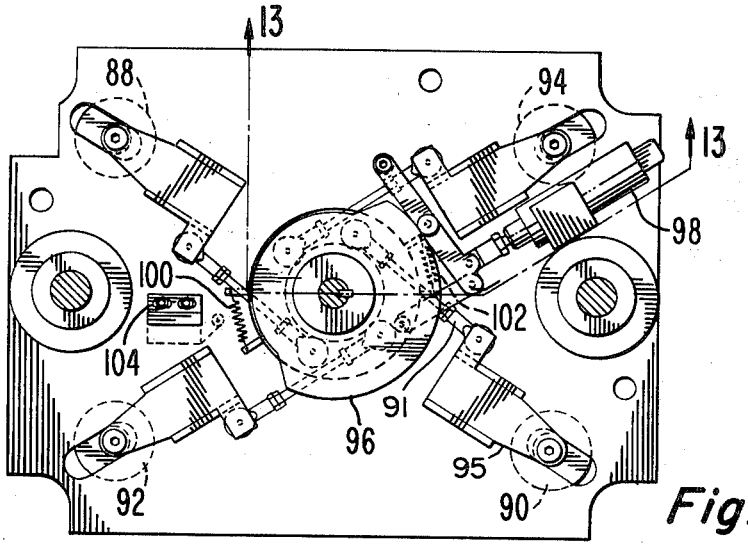
FIG. 12 is a bottom view of the mask locking assembly taken at lines 12—12 of FIG. 11.
Figure 11:
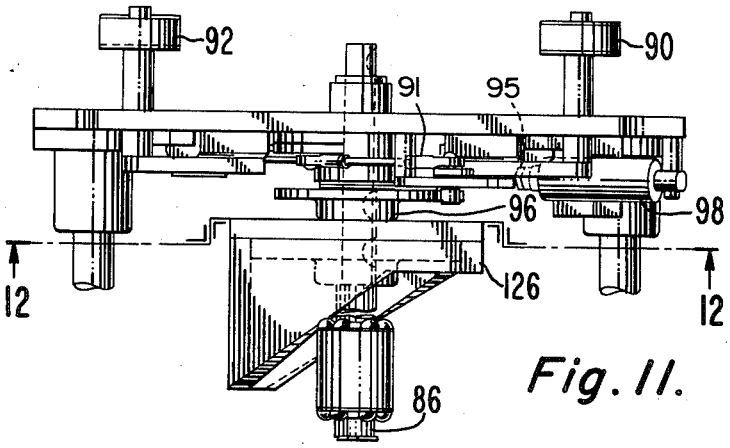
FIG. 11 is a side view of a mask locking assembly portion of the mask inserter of FIGS. 3, 4 and 5.

The first action caused by the cam 96 rotation is to bring the frame locking spools 88, 90, 92 and 94, shown in FIGS. 11 and 12, into contact with the inside corners of the frame. The four locking spools 88, 90, 92 and 94 are driven by an air cylinder 98 sequentially into the four corners of the frame. Two spools 88 and 90 are spring loaded by springs 100 and 102 to accept frame inner contour variations as shown in FIG. 12. As a cam 96 is rotated, spring loaded frame locking spool is driven outwardly by air cylinder 98 through a slide 95 and a linkage 91, which is pivoted to the cam 96 thus exerting pressure on one corner of the frame. The cam 96 rotation also drives non-spring loaded locking spools 92 and 94 and spring loaded locking spool 88 into the other corners of the frame through similar linkages and slides. The placement of these four spools securely locks the mask-frame assembly into its correct horizontal and vertical orientation.

Figure 13:
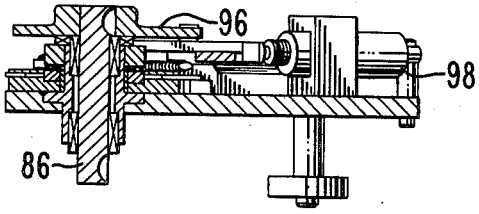
FIG. 13 is a sectional view of the mask locking assembly taken at lines 13—13 of FIG. 12.
Figure 14:
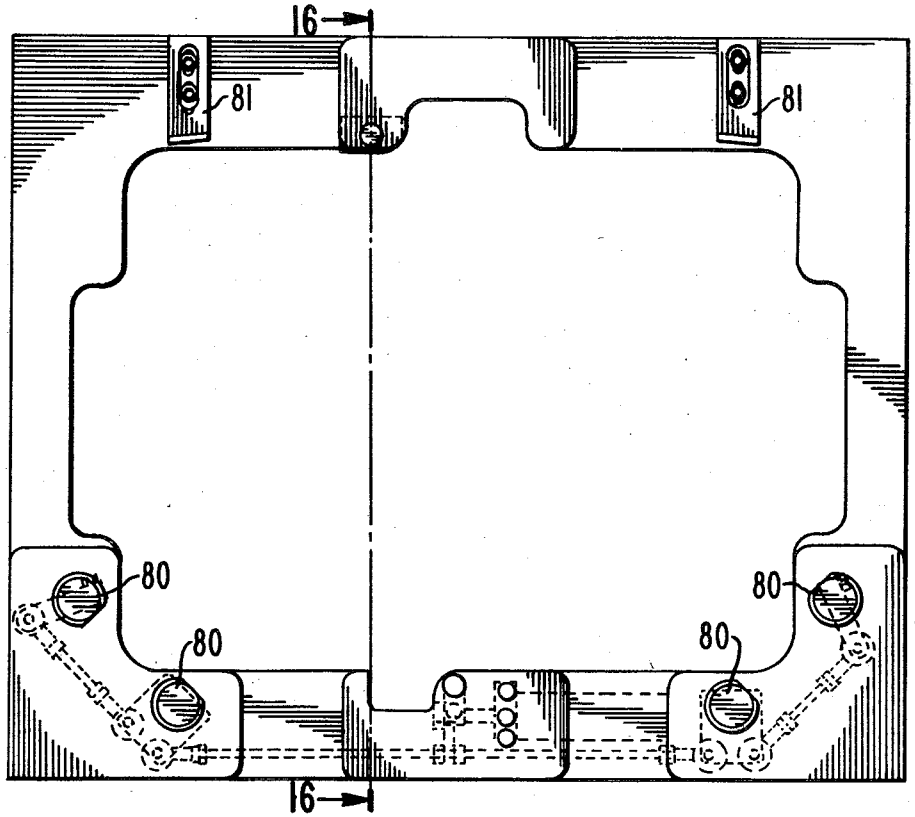
FIGS. 14, 15 and 16 are top, front and side views, respectively, of a faceplate panel locator assembly.

The next action is to fix the fork-shaped stud finder 72, shown in FIGS. 9 and 10, in position. As previously noted, these stud locators 72 are integral with the spring hole locating pin 70. Since the pins 70 are now seated in the spring holes and the pin and stud locators are exactly aligned, it is necessary to lock this condition in place. As cam 96, shown in FIGS. 12 and 13, continues its cycle, it triggers an air switch 104, shown in FIG. 12. This air switch 104 activates air cylinders 106, shown in FIG. 7. This action drives the rod end of the air cylinders 106 against the under side of the movable slide assembly 76 locking the entire slide system in place.

Figure 6:
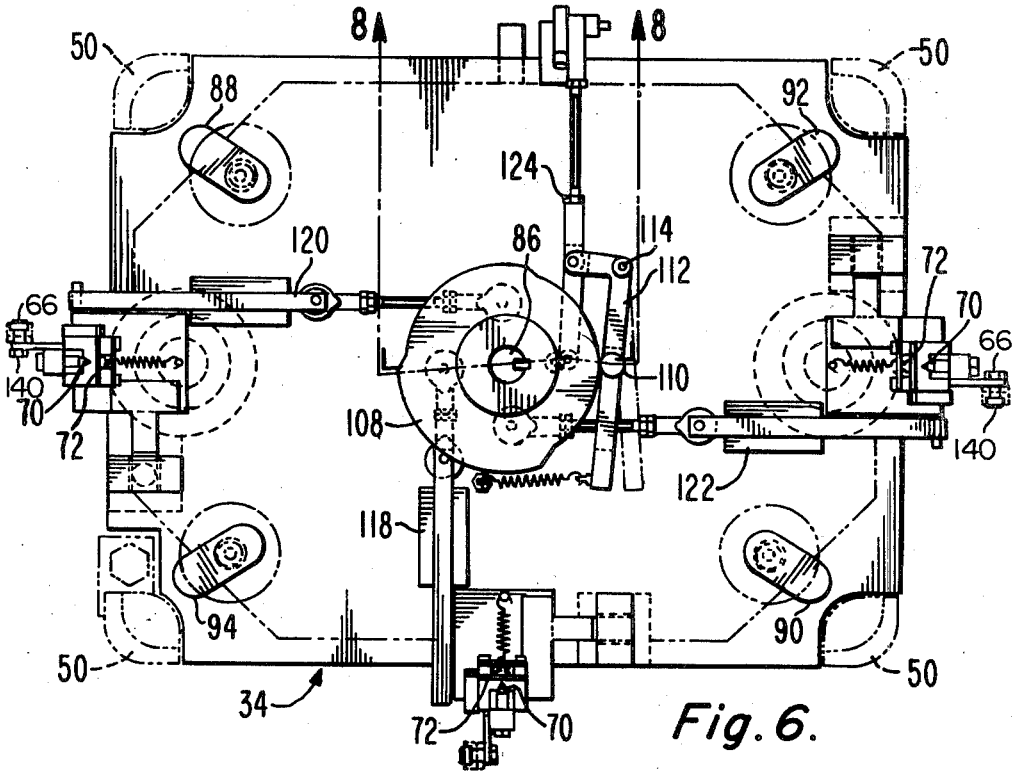
FIGS. 6 and 7 are top and front views, respectively, of a mask locator assembly portion of the mask inserter of FIGS. 3, 4 and 5.

Next, it is necessary to compress the frame springs in order to clear the panel studs during the insertion action and also to remove the locating pins 70 from the spring holes. As the main cam shaft 86 rotates, a spring compressor activating cam 108, shown in FIGS. 6 and 8, moves against a cam follower 110, shown in FIG. 6. The follower 110 is affixed to an L-shaped linkage rod 112 pivoting about a center 114. Attached to the end of the linkage rod 112 is an intermediate cam 116, shown in FIG. 8. As shown in FIG. 6 attached to this cam 116 are three linkage systems 118, 120 and 122. A fourth compression linkage 124 is connected to the L-shaped linkage rod 112. As the cam shaft 86 drives the cam 108, the entire spring compression system of the four interconnected linkages 118, 120, 122 and 124 are also driven as a unit to move the spring compressors 71 (FIGS. 9 and 10) toward the frame. The spring compressors 71 push the frame springs inward toward the frame freeing them from the locating pins 70 and holding the springs in place to clear the studs upon insertion of the mask-frame assembly into the faceplate panel. The cam shaft 86, FIG. 11 rotates a riser cam 126, shown in FIGS. 3, 4 and 11, riding against a cam follower 128, shown in FIG. 4. The cam follower 128 is attached to a bracket 130 which in turn is secured to an intermediate fixed plate 132 which is part of the bearing plate assembly 38. As the riser cam 126 turns against the cam follower 128 the riser cam 126 is caused to rise by its contour surface. This raises the mask-frame locator assembly 34 of FIGS. 3, 4, 6 and 7. The vertical motion of the assembly 34 causes the spring hole locating pins 70 to be withdrawn from the spring apertures by the actuating bits 140 and placed in a free attitude as shown in "C" at FIG. 10.

Figure 15:
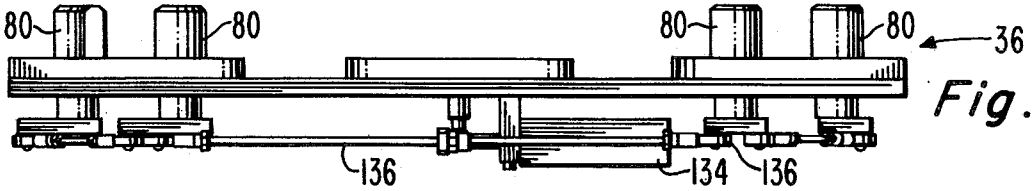
Figure 16:
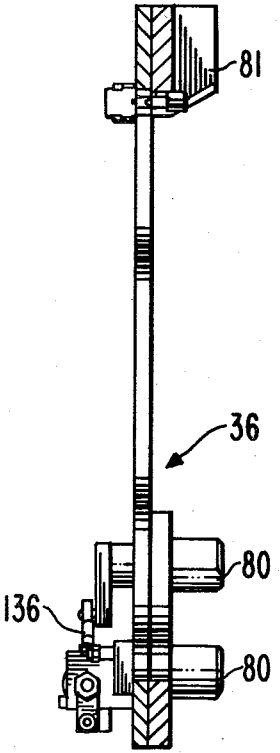

As the mask-frame locator assembly moves into the faceplate panel, action must be taken to insure that the faceplate panel is free to be moved into proper orientation with the incoming mask frame assembly. As previously mentioned, the faceplate panel was placed within the guides 80 and 81 with the seal land facing down. The guides 80 and 81 are set to provide only enough clearance to accept the largest specified faceplate panel criteria. However, due to manufacturing inaccuracies which cause wide variations in individual tolerances, placement of the studs is not exactly the same in every faceplate panel. Thus when the support springs are welded to the frame using the panel as a locating jig, the resulting assemblies are not uniform. In order to overcome this difficulty and to allow the panel to be moved into its proper orientation, it is necessary to remove the restriction set by the guides 80 and 81 used to originally locate the panel when it was loaded. As the mask-frame locator assembly 34 moves upward, an air switch (not shown) is activated. This activates an air cylinder 134, shown in FIG. 15, causing the interconnecting linkages 136 to move. The ends of these linkages 136 are attached to the lower ends of the guides 80 which are free to rotate about their centers. As the linkages move they cause the guides 80 to rotate a sufficient amount so as to present a flat portion of the guides 80 to the panel. Presence of these flat portions reduces the outer diameter of the guides 80 by a substantial localized amount. This amount of extra movement is now available to permit movement of the panel.

While the panel guides 80 are being rotated, the upward motion of the mask-frame locator assembly 34 is proceeding. As the assembly enters the panel, the fork-shaped stud locators 72 enter the panel at the areas of the studs. Because of the V-shape of the inside of the stud locator 72, they have the capability of finding their respective stud even though they are not aligned. The stud locators 72 thus capture the studs and due to the freedom given to the faceplate panel by rotating the panel guides 80, the panel is free to move into correct alignment. The panel is raised off the pads and is supported only by the studs resting in the V-shaped locators 72. At this time, the following conditions prevail. The panel is securely held by the primary locating points, the studs. It is held in true alignment and orientation with the mask-frame assembly since all variables which have entered the assemblies during fabrication have been provided for by permitting the spring hole locating pins 70 to move into position to compensate for any errors in frame spring location and by permitting the faceplate panel to be moved into correct alignment with the mask-frame assembly.

Now that the mask-frame assembly has been brought into proper orientation with the faceplate panel, provisions are made to attach the mask-frame assembly onto the faceplate panel. As the main cam shaft 86 continues its rotation, the spring compressing cam 108 is now brought to its opposite lobes which actuates intermediate cam 116 permitting the spring compressor linkages 118, 120, 122 and 124 to release the springs to their normal inserted positions. This action places the support springs correctly on the panel studs, completing the mask-frame assembly insertion operation.

Following the insertion operation, it is necessary to prepare the unit for the next loading sequence. Further rotation of the cam shaft 86 brings the high lobe of the cam 96 into contact with a roller 138 which brings the frame locking spools 88, 90, 92 and 94 inward to the center of the unit. Continued rotation of the cam shaft 86 releases the air switch 104 releasing the saddle clamping air cylinders 106. Continued rotation of the cam 96 lowers the mask locator assembly 34 below the level of the mask-frame insertion. At this time, the spring compressors and stud locators 72 are open to their mask load position. The mask-frame locator assembly 34 is now returned to its lower position by further rotation on the cam 96. The final few degrees of cam shaft rotation brings the cut-off lobe of the cam 96 into position to stop the electric motor 84 and at the same time activate an air switch (not shown) to cause the piston rod of the air cylinder 56 to raise. This action raises the mask post assembly 32 into its upper position placing the mask-frame locating nest at its load position. At this point, the completed mask-frame-panel assembly can be removed either by manual or mechanical means. The apparatus is now ready to receive the next mask-frame assembly and repeat the operation of inserting the assembly into a faceplate panel.

What is claimed is:

1. An automatic apparatus for inserting a mask assembly into a cathode ray tube faceplace panel, said mask assembly including an apertured shadow mask having at least three springs attached thereto, each spring including an aperture, said faceplate panel including a viewing faceplate portion and a peripheral sidewall, said sidewall including at least three studs embedded therein for engagement with said spring apertures, said apparatus comprising:

means for holding said faceplate panel with the internal side down, a vertically movable assembly located below said means for holding said faceplate panel, said vertically movable assembly including a subassembly at each mask spring location, at least three of said subassemblies each including a stop for contacting the lower edge of a mask spring, each subassembly also including a locator pin for locating said spring aperture, said locator pin being movable between an engaged position and a disengaged position, said subassemblies being horizontally movable peripherally with respect to said mask assembly to align said locator pin with said spring apertures, said locator pin when in said engaged position being spaced from said stop a predetermined spacing equal to a standard spacing between a lower edge of a spring and the centerline of the spring aperture plus a predetermined lifting distance whereby said locator pin raises said mask assembly from said stop when in said engaged position, each subassembly further including a fork-shaped stud finder centered with respect to said locator pin, and said vertically movable assembly further including means for locking the position of a mask assembly and means for depressing said mask springs, whereby when a mask assembly is mounted on said vertically movable assembly, said springs rest on said stops when said locator pin is in said disengaged position, and said horizontally movable subassembly can move horizontally to align said locator pin and said spring apertures when said locator pin moves from said disengaged position to said engaged position, and said fork-shaped stud finder engages said stud on said faceplate panel to align said stud and said spring aperture.

* * * * *